United States Patent [19]

Broyden

[11] Patent Number: 4,470,780

[45] Date of Patent: Sep. 11, 1984

[54] AIR MOTOR VANE LIFTING DEVICE

[75] Inventor: Robert H. Broyden, Williamsville, N.Y.

[73] Assignee: Columbus McKinnon Corporation, Amherst, N.Y.

[21] Appl. No.: 437,139

[22] Filed: Oct. 27, 1982

[51] Int. Cl.[3] ..... F01C 1/00; F01C 19/00

[52] U.S. Cl. ..... 418/133; 418/144; 418/258

[58] Field of Search ..... 418/133, 144, 257, 258

[56] References Cited

U.S. PATENT DOCUMENTS

| | | | |
|---|---|---|---|
| 1,029,186 | 6/1912 | Green | 418/258 |
| 2,311,162 | 2/1943 | Du Bois | 418/144 |
| 2,750,816 | 6/1956 | Mott | 418/257 |
| 3,976,407 | 8/1976 | Gerlach | 418/144 |

FOREIGN PATENT DOCUMENTS

| | | | |
|---|---|---|---|
| 164799 | 8/1954 | Australia | 418/257 |
| 53-89006 | 8/1978 | Japan | 418/144 |
| 3884 | of 1876 | United Kingdom | 418/257 |
| 839648 | 6/1960 | United Kingdom | 418/257 |

*Primary Examiner*—John J. Vrablik

*Attorney, Agent, or Firm*—Bean, Kauffman & Bean

[57] ABSTRACT

There is disclosed for use in powering a hoist or the like a pressured fluid powered machine of the rotary vane motor or pump type, improved means for "lifting" and maintaining the vanes in pressure-sealing contact with the wall of the machine casing, and for substantially preventing pressure losses around the ends of the vanes particularly when the machine is starting up and/or operating at low speeds. A pair of resilient "lifting rings" are provided to ride under the vanes at opposite ends thereof and "air cushion" float about specially shaped seals fixed upon opposite ends of the casing, so as to function at all times to maintain the vanes in contact with the machine casing inner wall. The seals operate to prevent fluid leakages via the vane accommodating slots in the machine rotor around the ends of the vanes; thereby providing the machine with a smooth torque output capability at start-up and low operating speeds, such as is of particular importance in hoisting machine systems. Also, the inboard and outboard edges of the vanes are of improved configurations in order to provide improved vane operating and pressure-sealing effects.

2 Claims, 5 Drawing Figures

Fig. 1.
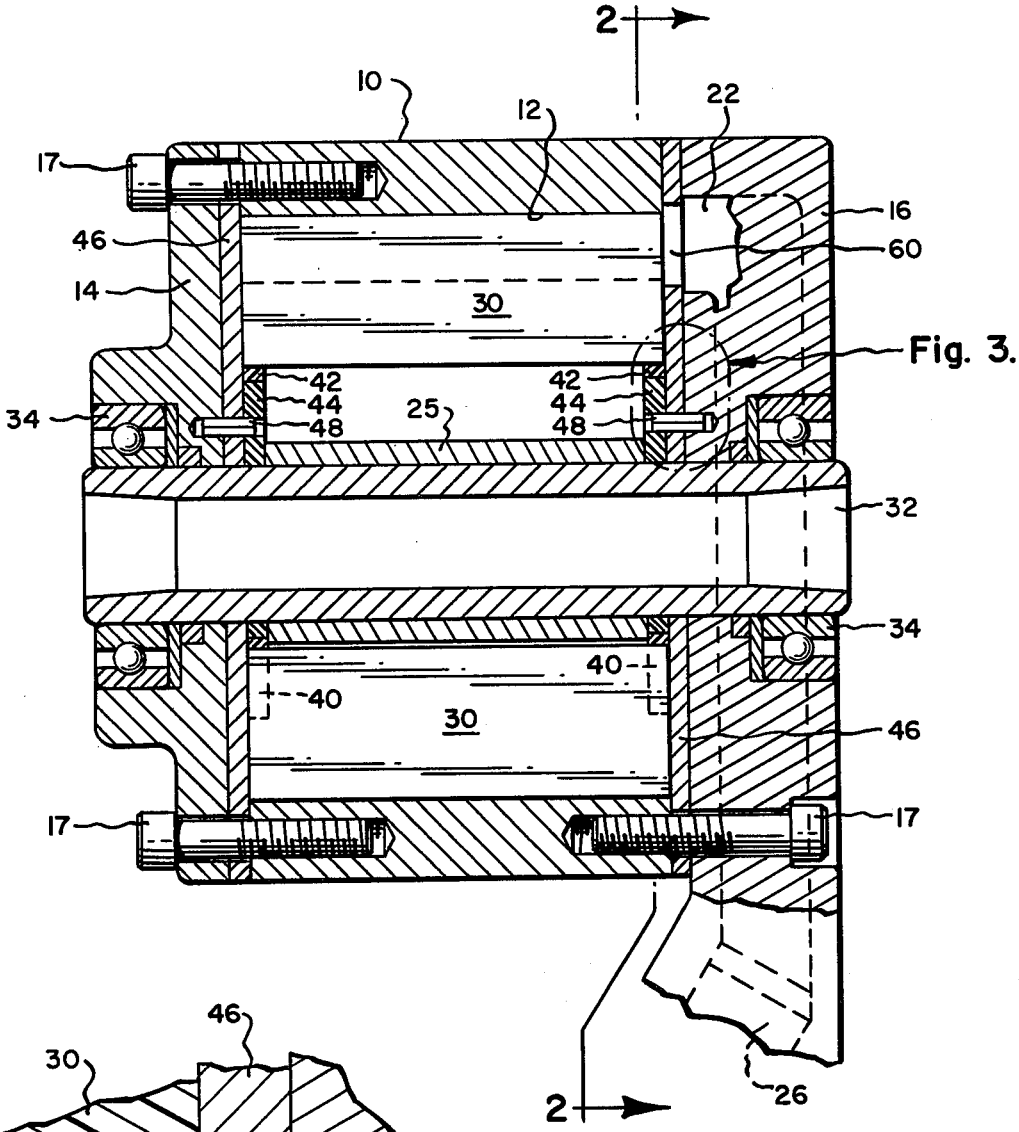
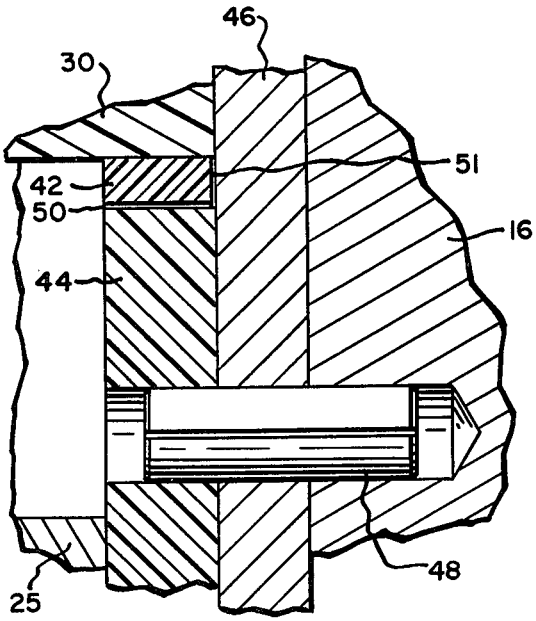
Fig. 3.

Fig. 2.
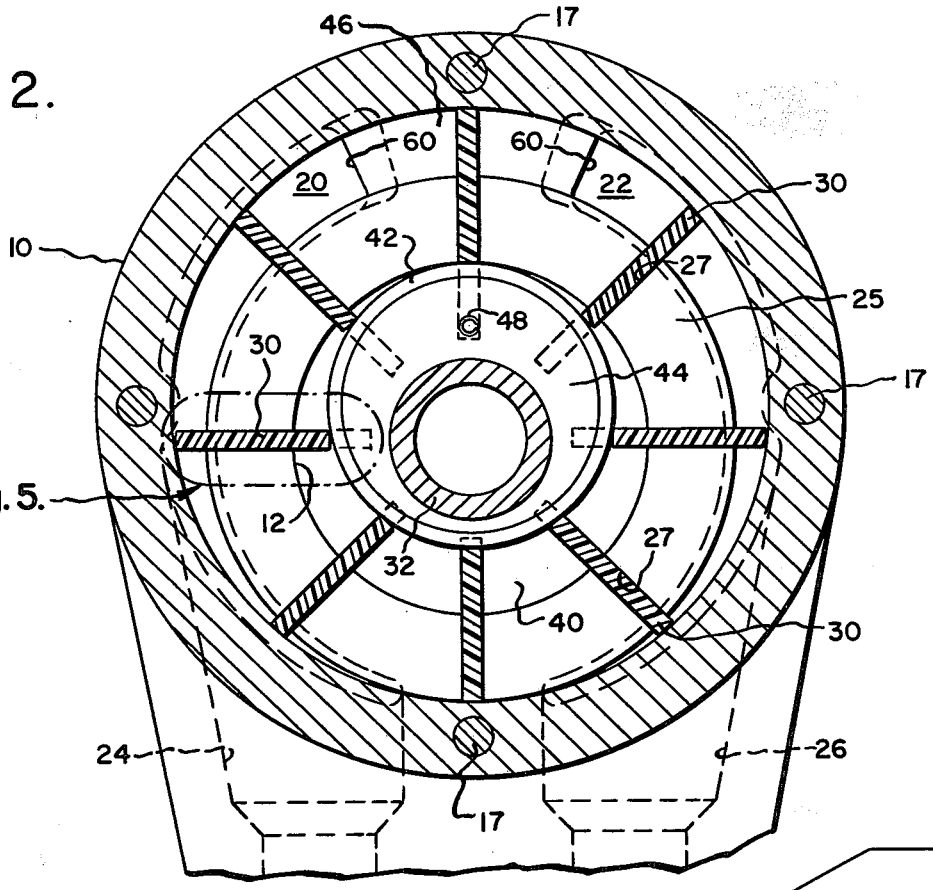
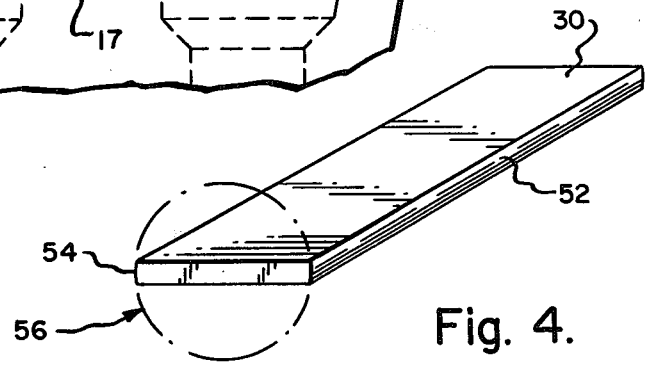
Fig. 4.
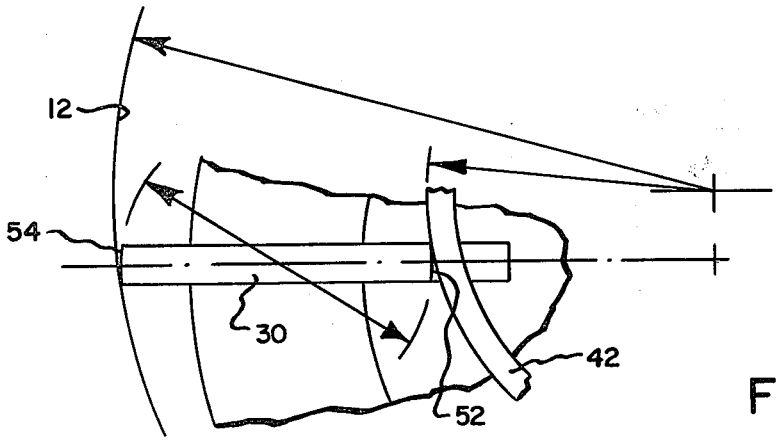
Fig. 5.

AIR MOTOR VANE LIFTING DEVICE

BACKGROUND AND OBJECTS OF THE INVENTION

This invention relates to the field of machines of the vane type rotary motors and pumps; and more particularly to means for sealing the vanes thereof relative to the machine casing as well as the ends of the vane carrying slots of the rotor, against pressure leakages when centrifugal operating forces acting on the vanes are insufficient to maintain them in efficiently sealing contact with the wall surface of the machine casing. The problem of establishing such effective seals between the vanes and the walls of the motor cavity to provide efficient start-up and slow running capabilities for the machine has been a major handicap against usage of such machines, especially in the hoisting machine industry.

Therefore, an object of the present invention is to provide an improved form of pressured fluid powered machine including means by which the vanes of the machine are caused to be in pressure-sealing relation against the cylinder walls even when the rotor thereof is stationary; thereby insuring immediate start-up driving power for the machine as well as smooth torque output at any desired rate of variable speed and thus eliminating delay in achieving full power drive by the machine as well as a smoother operation at slow speeds. Another object is to provide in a machine of the type described vanes of improved configurations whereby an improved pressure sealing arrangement is provided for the vanes vis-a-vis stationary parts of the machine casing; thereby reducing the rate of wear on the operating parts of the machine.

Essentially, then, the present invention provides a hoist powering motor of the pressurized-fluid powered rotary vane type comprising: a casing having a cylindrical inner wall surface; end bells at opposite sides of said casing defining a fluid cavity therein; compressed fluid inlet and outlet ports in one of said bells in open communication with said fluid cavity; a rotor extending between said end bells carried by a drive shaft for rotation about an axis eccentric to said casing inner wall surface; said rotor provided with counterbored end portions adjacent said end bells and a plurality of longitudinally extending radial slots about the periphery thereof, each of said slots having inner portions communicating with said counterbored end portions; a plurality of vane devices slidably carried within said slots having inboard edge portions and outboard edges; a resilient vane lift ring disposed adjacent the inner surface of each of said end bells and located within the confines of each of said counterbored end portions in constant bearing engagement with said vane inboard edge portions to urge said vane outboard edges into contact against said casing inner wall surface; and a resilient seal plate substantially coplanar with each of said lift rings having a circular periphery concentric with said inner surface of said casing fixed with respect to the inner surface of each of said end bells and accommodated within each of said counterbored end portions in close spaced relationship with the inner periphery of each vane lift ring to permit said lift ring to orbit in contact with said vanes without dragging against said seal plates.

BRIEF DESCRIPTION OF THE DRAWINGS

FIG. 1 is a sectional view through an exemplary rotary vane machine of the present invention;

FIG. 2 is a sectional view taken as along line 2–2 of FIG. 1;

FIG. 3 is a fragmentary enlarged scale view of the encircled portion of FIG. 1 identified by the item "FIG. 3";

FIG. 4 is a perspective view of one of the vanes of the motor; and

FIG. 5 is a fragmentary enlarged scale view of the encircled portion marked "FIG. 5" of FIG. 2.

DESCRIPTION OF THE PREFERRED EMBODIMENT

The rotary machine of the invention is illustrated herein as being of the directionally reversible type, such as is useful in powering hoisting machinery and the like. The machine includes a cylindrical-shaped casing or housing 10 which has an inner cylindrical wall surface 12 and is closed at its opposite ends by end bells 14,16 such as by means of machine screws 17 or the like. As shown, the end bell 16 includes angularly spaced apart fluid transport ports 20,22 intercommunicating the interior cavity of the machine and associated passageways 24,26 (FIG. 2) which lead to the machine control valve (not shown) whereby the ports 20,22 may alternately be in communication with compressed fluid supply and exhaust couplings of the machine for directionally reversible operation thereof, as is known in the art.

The rotor 25 of the machine is provided with a number of elongated vane slots 27 cut therein on the radius thereof; and within these slots are mounted in freely slidable relation therein a plurality of vanes 30. The machine drive shaft 32 is press-fitted into the rotor 25 (or otherwise keyed thereto) and is rotatably mounted in the end bells 14,16 as by means of bearings 34,34. The rotor 25 is concentrically mounted and positioned with respect to the axis of the drive shaft 32 as shown in FIG. 2, but the shaft 32 is eccentrically mounted relative to the cylindrical inner wall 12 of the casing 10. Accordingly, it will be understood that for efficient operation of a machine of this type, as the rotor turns within the casing it is required for the outboard edges of the vanes 30 to be at all times in pressure-sealing contact with the inner surface 12 of the casing 10 while reciprocatively sliding in the slots 27; and that pressure losses around the ends of the vanes permitting escape of fluid to the exhaust, must also be prevented.

To attain the aforesaid objectives, in the case of the present invention the rotor 25 is concentrically counterbored at its opposite ends as shown at 40 (FIGS. 1 and 2) to accommodate therein vane lift rings 42,42 as well as seal plates 44,44 against which the ends of the counterbored portions of the rotor 25 slide. In addition, seal pads 46,46 are preferably fixed against the inner surfaces of the end bells 14,16 upon which the major end portions of the rotor and vane assembly slide. The seals 44,44 are also fixed relative to the end bells 14,16 as by means of roll pins 48 or the like.

The lift rings 42,42 are of highly resilient character and may preferably be formed of some suitable long wearing plastic composition such as a laminated phenolic having slide surface sealing characteristics and are substantially coplanar with the seal plates 44, as shown. The rings are so dimensioned that when installed in the machine under the inboard edges of the vanes 30, they are under slight compression and therefore constantly maintain a slight bias against each of the vanes, thereby holding all of them outwardly against the machine casing when the rotor is stationary as well as when running.

Thus, the machine is capable of prompt start-ups and acceleration up to operating speeds such as when the vanes would run snugly against the casing under the influence of centrifugal forces. The seals 44,44 are also made of long wearing resilient material such as a laminated phenolic as referred to above, and function to prevent pressured fluid from escaping away from the "working" portion of the rotor/vane cavity of the machine, along down the sides of the vanes and around the counterbored surfaces 40 of the rotor 25 and into passageways leading to the machine exhaust.

It is a particular feature of the invention that the seals 44,44 are peripherally dimensioned so at to avoid interference with the working progress of the lift rings 42,42 as they rotate around with the vanes 30; and for this purpose a clearance of between 4/1000 and 10/1000 of an inch is provided as depicted at 50 (FIG. 3) between the outer peripheries of the seals 44,44 and the inner peripheries of the lift rings 42,42. Thus, although the seals 44,44 do not interfere with the desired functioning of the rings 42,42 they are enabled to function to substantially prevent loss of fluid pressure from the vane accommodating slots around the major portions of the ends of the vanes relative to the end bells 14,16 as explained hereinabove. The seal pads 46,46 are also made of long wearing resilient material such as a laminated phenolic as referred to above. Furthermore, as depicted at 51 (FIG. 3), a free-running clearance is provided between the edges of the lift rings 42,42 and their adjacent seal pads 46,46, whereby the lift rings are free to float in orbit with the vanes 30 while avoiding any rubbing against the seals 46,46. Any leading or lagging of the vanes 30 relative to the rings 42,42 while in orbit will be reflected in minor relative movement therebetween which is of no substantial consequence, whereby this system encounters overall reduced wear problems on both the rings 42,42 and the vanes 30.

It is another particular feature of the invention that the parts 60,60 (FIGS. 1 and 2) through the seal pad 46 adjacent the end bell 16 may be variously located or positionally adjustable relative to the fluid ports 20,22 in the end bell so as to provide the preferred of a variety of possible fluid pressure supply and cut-off adjustment arrangements in order to accommodate various fluid expansion characteristics, and therefore to attain the smoothest possible machine operation such as is so important in connection with precise positioning hoist operations.

FIGS. 4 and 5 illustrate another feature of construction of the vanes employed in the machine. Note that both the inboard and outboard edges 52,54 of the vanes are rounded on a radius such as suggested by the circle 56 (FIG. 4), whereby as illustrated at FIG. 5 the vanes are free to rock back and forth relative to both the casing surface 12 and the lift rings 42,42 as the rotor 25 turns within the casing. Thus, the vanes always present the same diametral length between the seal ring 42 and inner casing surface 12, which are at a fixed distance apart, and therefore never present any sharp edges to either the casing surface or the lift rings. Thererfore, wearing problems relative to these parts are greatly minimized.

I claim:

1. A hoist powering motor of the pressurized-fluid powered rotary vane type, comprising:

a casing having a cylindrical inner wall surface;

end bells at opposite sides of said casing defining a fluid cavity therein;

compressed fluid inlet and outlet ports in one of said bells in open communication with said fluid cavity;

a rotor extending between said end bells carried by a drive shaft for rotation about an axis eccentric to said casing inner wall surface;

said rotor provided with counterbored end portions adjacent said end bells and a plurality of longitudinally extending radial slots about the periphery thereof, each of said slots having inner portions communicating with said counterbored end portions;

a plurality of vane devices slidably carried within said slot having inboard edge portions and outboard edges;

a resilient vane lift ring disposed adjacent the inner surface of each of said end bells and located within the confines of each of said counterbored end portions in constant bearing engagement with said vane inboard edge portions to urge said vane outboard edges into contact against said casing inner wall surface; and a resilient seal plate substantially coplanar with each of said lift rings having a circular periphery concentric with said inner surface of said casing fixed with respect to the inner surface of each of said end bells and accommodated within each of said counterbored end portions in close spaced relationship with the inner periphery of each vane lift ring to permit said lift ring to orbit in contact with said vanes without dragging against said seal plates and in sliding engagement with opposite ends of said rotor within said counterbored end portions.

2. A hoist powering motor as set forth in claim 1, further comprising:

a pair of resilient circularly shaped seal pads fixed one each against inner surfaces of said end bells for slidebearing relation with opposite ends of said vanes and in close spaced relation with said lift rings, and that one of said seal pads fixed to said one of said end bells has ports for placing said inlet and outlet ports in communication with said fluid cavity and said ports are positionally adjustable relative to said inlet and outlet ports.

* * * * *